US006752725B2

(12) United States Patent
Kim

(10) Patent No.: US 6,752,725 B2
(45) Date of Patent: Jun. 22, 2004

(54) GOLF BALL HAVING DIRECTION-SIGHTING INDICATIONS AND MOLD FOR MANUFACTURING THE SAME

(76) Inventor: Hong-Ki Kim, Room 1201, Nadong, Donshin Apartment, 902-8, Dogok-Dong, Kangnam-Ku, Seoul (KR)

( * ) Notice: Subject to any disclaimer, the term of this patent is extended or adjusted under 35 U.S.C. 154(b) by 0 days.

(21) Appl. No.: 10/394,897

(22) Filed: Mar. 21, 2003

(65) Prior Publication Data

US 2003/0181253 A1 Sep. 25, 2003

(30) Foreign Application Priority Data

Mar. 25, 2002 (KR) ..... P-10-2002-16053

(51) Int. Cl.[7] ..... A63B 69/36
(52) U.S. Cl. ..... 473/280
(58) Field of Search ..... 473/280, 218, 473/266, 268, 270, 351, 353, 407; 40/327

(56) References Cited

U.S. PATENT DOCUMENTS 676,506 A * 6/1901 Knight et al. ..... 473/268
4,209,172 A * 6/1980 Yamamoto ..... 473/200
4,284,276 A * 8/1981 Worst ..... 473/383
4,706,958 A * 11/1987 Inoue ..... 473/268
5,060,954 A * 10/1991 Gobush ..... 473/379
5,067,719 A * 11/1991 Mook ..... 473/200
5,143,377 A * 9/1992 Oka et al. ..... 473/383
5,713,799 A * 2/1998 Balmat ..... 473/200
6,004,223 A 12/1999 Newcomb
6,422,949 B1 7/2002 Byrne et al.
2003/0181253 A1 * 9/2003 Kim ..... 473/280

* cited by examiner

*Primary Examiner*—Raleigh W. Chiu
(74) *Attorney, Agent, or Firm*—Roth & Goldman, P.A.

(57) ABSTRACT

A golf ball having direction-sighting indications, with which a golfer can easily sight a direction for the golf ball to fly when he/she strikes the ball with one of golf clubs, and a mold for manufacturing such golf balls. The golf ball according to the present invention has a first indicating line having a plurality of indicating holes distinguishable in shape and dimension from normal dimples formed on an outer surface of the golf ball. The first indicating line establishes a straight line extending along an equator on the surface of the golf ball to form a first direction indicating line, on which a starting point and an ending point are identical. A second indicating line, having a plurality of indicating holes identical in shape and dimension to those of the first indicating line, is formed on the surface of the golf ball. The second indicating line establishes a second direction indicating line so that two crossing points with the first indicating line are formed and, at the same time, a first axis is formed through the two crossing points and a center of the golf ball.

3 Claims, 4 Drawing Sheets

GOLF BALL HAVING DIRECTION-SIGHTING INDICATIONS AND MOLD FOR MANUFACTURING THE SAME

BACKGROUND OF THE INVENTION

1. Field of the Invention

The present invention relates, in general, to a golf ball having indications for guiding a golfer to sight a direction to hit the golf ball (hereinafter referred to as "direction-sighting indications") and a mold for manufacturing the same and, more particularly, to a golf ball having direction-sighting indications, with which a golfer can easily sight a desired direction for the golf ball to travel when he/she strikes the ball with one of golf clubs, and a mold for manufacturing such golf balls.

2. Description of the Prior Art

As well known to those skilled in the art, to make any shot in a golf game, a golfer initially determines a target point of a golf ball to hit the ball, adjusts his/her stance, knees, waist and shoulders so as to be parallel with the desired flight path of the ball, and then places the head of a golf club directly behind the golf ball so that the club head is aligned perpendicular to the desired flight path, which is a correct posture for a golf swing.

However, since the golfer is dependent upon eye-measurement to determine a target point of the golf ball, the actual flight path of the ball may be easily diverged from the desired flight path and the actual flight distance of the ball may be easily different from a desired flight distance.

In order to solve this problem, there has been provided a golf ball with marked lines formed through an additional process to mark the lines crosswisely on the outer surface of a golf ball, wherein the marked lines have been used as direction-sighting indications.

Referring to FIG. 1, the direction-sighting indications are produced by forming an X-axial line and an Y-axial line on the outer surface of a golf ball 100, wherein the X-axial line is parallel with a straight line "S" which passes along a golfer's stance for the correct swing, and the Y-axial line is parallel with a straight line 102 which passes along a hit face of a club head 101 to be perpendicular to the X-axial line. Therefore, the golfer is allowed to hit the golf ball 100 while placing the central point 103 of the hit face of the club head 101 such that the central point 103 is precisely aligned with the X-axial line. With the use of the indicating lines for sighting the direction, the golfer is able to hit the golf ball 100 so that it flies in a correct target direction to reach a desired distance.

The marked lines used as direction-sighting indications according to a conventional art have been printed on the outer surface of a golf ball. As well known to those skilled in the art, the outer surface of a golf ball is formed with hundreds of dimples (slight depressions or indentations formed on the outer surface) and thus it is not easy to mark lines on the outer surface of the golf ball so as to divide the outer surface into equal parts. If the marked lines are inclined to any side to be eccentric from the center of the golf ball, the golfer is unable to hit the golf ball in the target direction as desired. Further, it is not easy to correctly position a golf ball based on the marked lines, on the golf course. In addition, since the line-marking has been performed directly on golf balls through an additional process, about 60% to 70% of produced golf balls have been discarded in the course of marking the lines on the surfaces of the golf balls because correct line-marking has not been performed, which has caused the golf ball manufacturers a large amount of damages. Accordingly, there has been a heavy increase in production costs and a serious degradation in productivity of golf balls. Also, since the line-markings on the surfaces of golf balls are made with colors on the white surfaces of the golf balls for visibility, the surfaces of the golf balls on which trademarks and other normal signs, etc, are normally printed, seem distracting and disordered; this has not allowed the golfer to concentrate on a golf game, thereby causing the golfer to make an incorrect shot, contrary to the original propose of marking the lines on the surfaces of the golf balls. Since the golf balls with marked lines have caused errors in golf swings, a high percentage of incorrectly marked lines, poor productivity, bad visibility, impaired concentration, and low competitive power, the golf balls, the surfaces of which are formed with marked lines, have not been commercially successful although they are very effective in theory.

SUMMARY OF THE INVENTION

Accordingly, the present invention has been made keeping in mind the above problems occurring in the prior art, and an object of the present invention is to provide a golf ball having direction-sighting indications, wherein a plurality of indicating holes (a kind of dimple), clearly distinguishable from the normal dimples in shape and dimension, are formed along equators on the outer surface of the golf ball during a process of forming the normal dimples on the golf ball, thereby producing indicating lines on two to six crossing points, whereby the golfer is allowed to conveniently sight a target direction to hit the golf ball.

Another object of the present invention is to provide a mold for manufacturing such golf balls.

In order to accomplish the above objects, the present invention provides a golf ball having direction-sighting indications, including a first indicating line having a plurality of indicating holes distinguishable in shape and dimension from dimples formed on an outer surface of the golf ball, the first indicating line establishing a straight line extending along an equator on the surface of the golf ball to form a first direction indicating line, on which a starting point and an ending point are identical, and a second indicating line having a plurality of indicating holes identical in shape and dimension to those of the first indicating line, and establishing a second direction indicating line so that two crossing points with the first indicating line are formed and, at the same time, a first axis is formed through the two crossing points and a center of the golf ball.

The golf ball further includes a third indicating line having a plurality of indicating holes identical in shape and dimension to the indicating holes of the first and second indicating lines, and establishing a third direction indicating line so that one pair of crossing points is respectively formed with each of the first and the second indicating lines, and a second axis and a third axis are respectively formed through the two pairs of crossing points and the center of the golf ball.

In the golf ball, the first, the second and the third indicating lines may be preferably formed on the outer surface of the golf ball such that two or more first, second and third indicating lines are formed on the surface of the golf ball at equal angular intervals, with the first, the second and the third axes being respectively set as mutual axes of the two or more first, second and third indicating lines.

According to another embodiment of the present invention, the above objects can also be made by providing a mold for manufacturing a golf ball having direction-sighting indications, comprising at least one cavity, with a plurality of indication-forming projections being formed along an inner surface of the cavity to form a plurality of indicating hole on an outer surface of the golf ball so as to form at least two of the first, second and third indicating lines on the outer surface of the golf ball.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
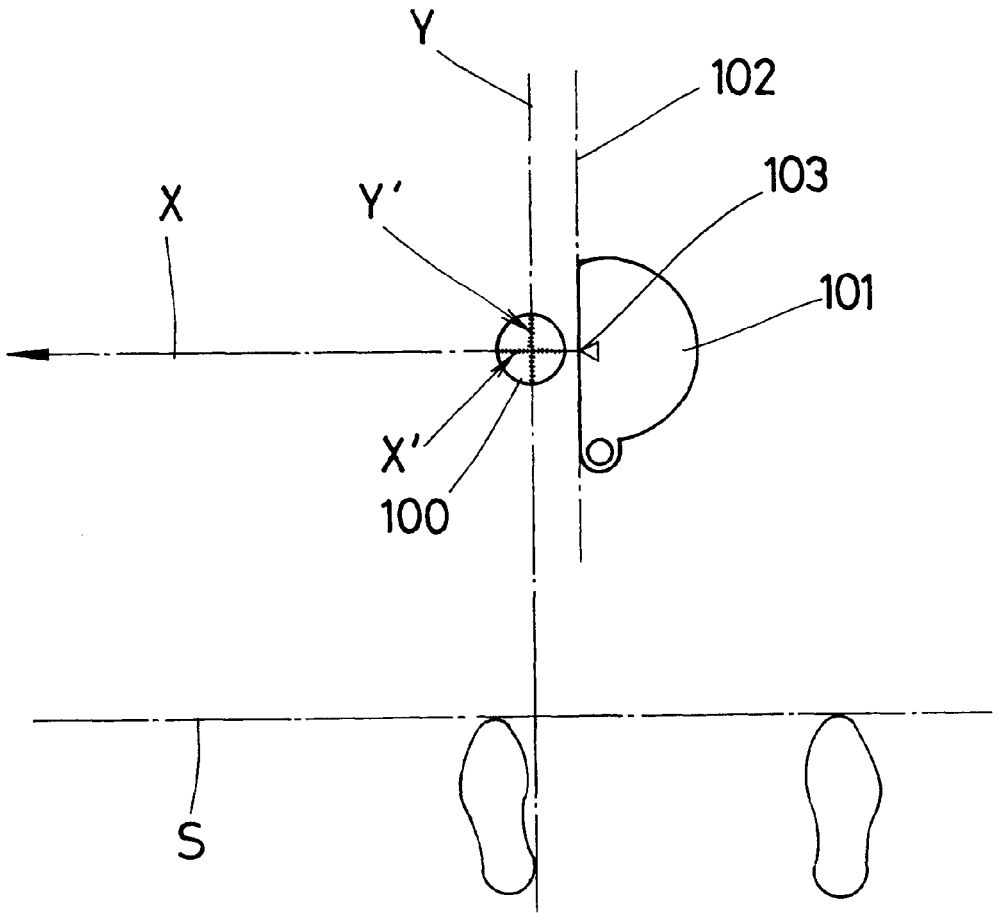
FIG. 1 is a schematic view explaining a mode of hitting a conventional golf ball.

Reference should now be made to the drawings, in which the same reference numerals are used throughout the different drawings to designate the same or similar components.

Figure 2:
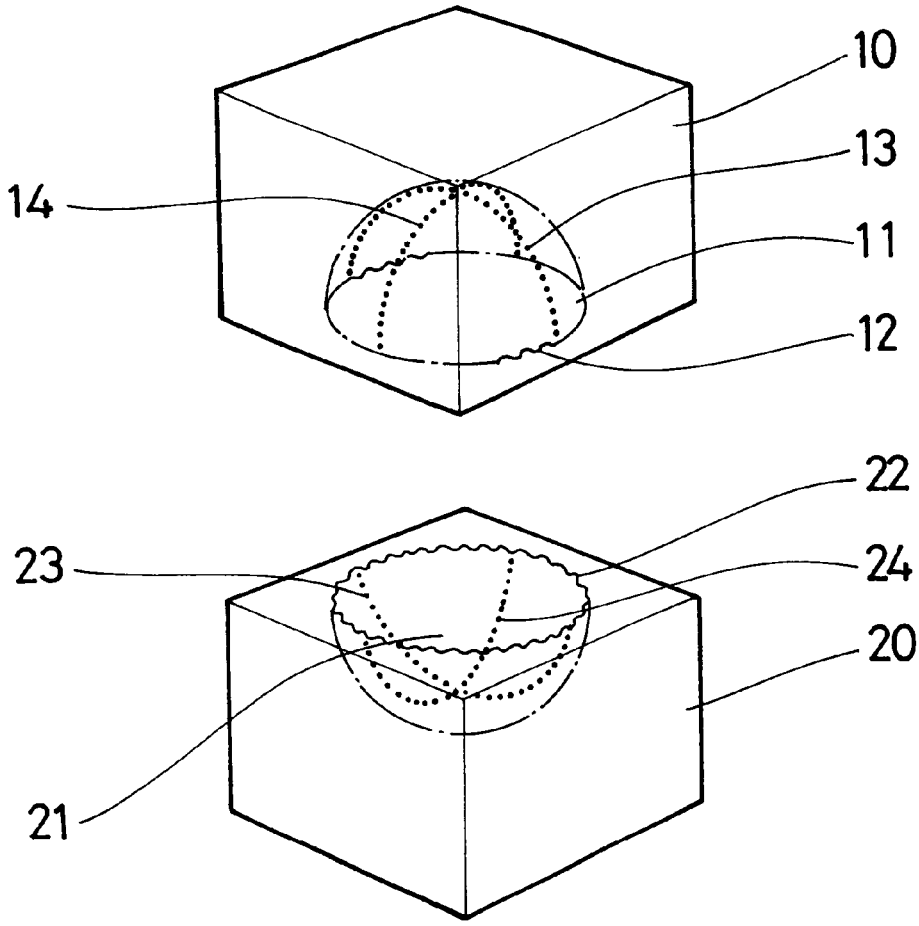
FIG. 2 is a perspective view of a mold for manufacturing a golf ball having direction-sighting indications, according to the present invention, when upper and lower molds are separated from each other.
Figure 3:
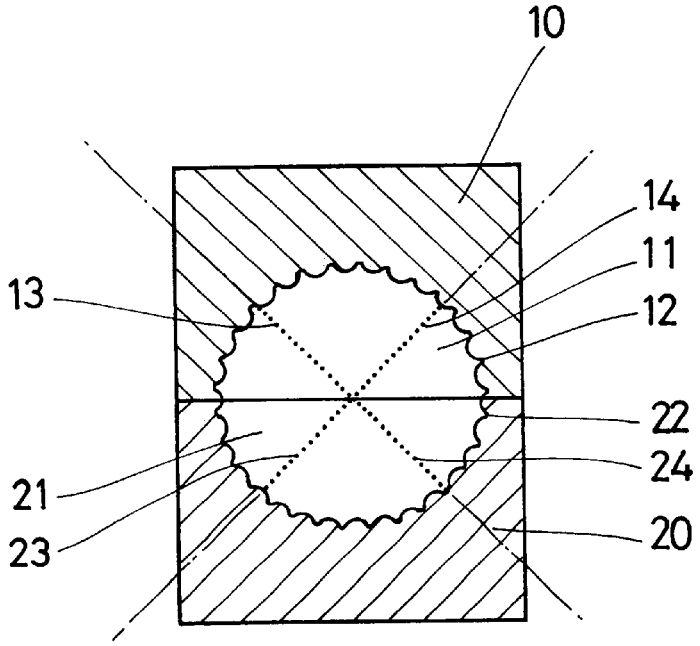
FIG. 3 is a sectional view of the mold according to the present invention, when the upper and lower molds are completely assembled with each other.
Figure 4:
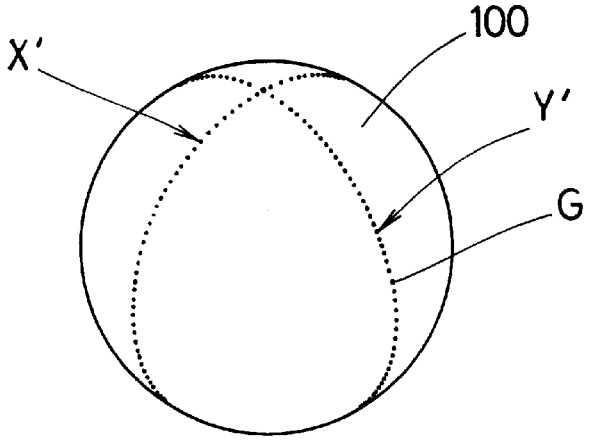
FIG. 4 is a perspective view of the golf ball having direction-sighting indications, according to a first embodiment of the present invention.
Figure 5:
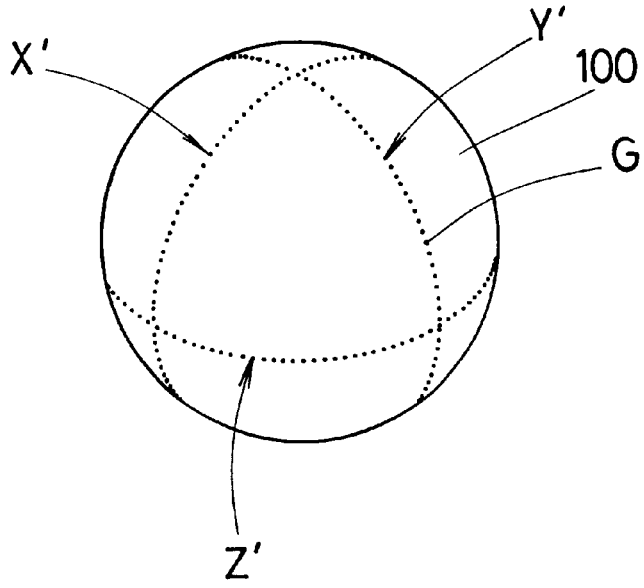
FIG. 5 is a perspective view of a golf ball having direction-sighting indications, according to a second embodiment of the present invention.
Figure 6:
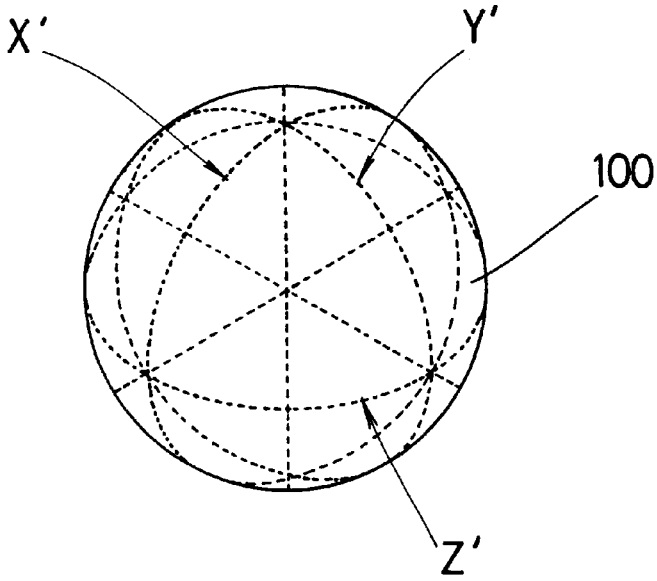
FIG. 6 is a perspective view of a golf ball having direction-sighting indications, according to a third embodiment of the present invention.

FIG. 2 is a perspective view of a mold for manufacturing golf balls each having direction-sighting indications, according to the present invention, when upper and lower molds are separated from each other. FIG. 3 is a sectional view of the mold according to the present invention, when the upper and lower molds are completely assembled with each other. FIG. 4 is a perspective view of the golf ball having direction-sighting indications, according to a first embodiment of the present invention. FIG. 5 is a perspective view of a golf ball having direction-sighting indications, according to a second embodiment of the present invention. FIG. 6 is a perspective view of a golf ball having direction-sighting indications, according to a third embodiment of the present invention.

As illustrated in FIGS. 2 and 3, a mold for manufacturing golf balls according to the present invention is comprised of an upper mold 10 and a lower mold 20, both having the same internal structure. The upper mold 10 and the lower mold 20 respectively have a first cavity 11 and a second cavity 21 so as to form a spherical inner face like the outer surface of a golf ball 100 to be produced.

The first cavity 11 and the second cavity 21 are both used to form the outer surface of a golf ball 100 through an injection molding process. On the spherical inner faces of the two cavities 11 and 21, a plurality of dimple-forming projections 12 and 22 used for forming normal dimples on the outer surface of the golf ball 100 are formed such that the projections 12 and 22 are spaced apart from each other at regular intervals. In such a case, the normal dimples of the golf ball 100 are different in dimension and constant in shape. The spherical inner faces of the two cavities 11 and 21 also have a plurality of smaller projections 13, 14, 23 and 24 (hereinafter referred to as "indication-forming projections") which are formed along equators of the inner faces such that the indication-forming projections 13, 14, 23 and 24 are clearly distinguishable from the dimple-forming projections 12 and 22 in dimension and shape, and lines formed by the indication-forming projections 13, 14, 23 and 24 are arranged perpendicularly to cross each other as in the X- and Y-axial lines. When golf balls 100 are produced by use of the upper and lower molds 10 and 20, indicating lines for guiding a golfer to sight a target direction to hit the golf balls 100 are formed on the outer surface of each golf ball 100 by the indication-forming projections 13, 14, 23 and 24 of the cavities 11 and 21.

When it is required to form three indicating lines on the outer surface of each golf ball 100, differently from a case that two indicating lines cross perpendicularly, the indication-forming projections 13, 14, 23 and 24 are arranged on the inner faces of the cavities 11 and 21 of the upper and the lower molds 10 and 20 so as to additionally form four crossing points on the X- and Y-axial lines.

The golf ball 100 manufactured by use of the mold described above has a first indicating line X' which establishes a first direction indicating line in the form of a straight line extending along an equator of the surface of the golf ball 100, on which a starting point and an ending point are identical, and which is formed by a plurality of indicating holes G distinguishable in dimension and shape from the normal dimples formed on the surface of the golf ball, as shown in FIGS. 4 and 5. In other words, the first indicating line X' is a direction indicating line meeting any one of planes among the XY, YZ or ZX planes, formed along equators of the golf ball 100, wherein the central point of a spherical coordinate system is the starting point of the XYZ coordinate system (or perpendicular coordinate system).

On the outer surface of the golf ball 100 is also provided a second indicating line Y' formed by a plurality of indicating holes G identical in shape and dimension to those of the first indicating lines X'. The second indicating line Y' establishes a second direction indicating line having two crossing points with the first indicating line X' and, at the same time, a straight line passing through the two crossing points and the center of the golf ball 100 defines a first axis. That is, if the first indicating line X' is a direction indicating line meeting the XY plane, the second indicating line Y' becomes another direction indicating line formed along an equator of the golf ball, meeting any one of the YZ or ZX planes.

Lastly, in order to increase the rate of correct sighting to hit the golf ball 100 in a target direction, the outer surface of the golf ball 100 is formed with a third indicating line Z', having one pair of crossing points respectively formed with each of the first and the second indicating lines X' and Y', and establishing a third direction indicating line so that two straight lines passing through the two pairs of crossing points and the center of the golf ball 100 are indicated as a second axis and a third axis, respectively. If the second indicating line Y' is a direction indicating line meeting the YZ plane, the third indicating line Z' becomes another direction indicating line formed along an equator of the golf ball 100, meeting the ZX plane.

Here, the first, the second and the third axes are respectively set as mutual axes of the first, second and third indicating lines Z' irrelevant to the coordinate system described above.

Based on the mutual axes as in the above, the first, the second and the third indicating lines X', Y' and Z' may be formed on the surface of the golf ball 100 such that two or more first, second and third indicating lines X', Y' and Z' are formed on the surface of the golf ball 100 at equal angular intervals, with the first, the second and the third axes being respectively set as the mutual axes of the two or more first, second and third indicating lines X', Y' and Z', as shown in FIG. 6.

As described above, by use of the golf ball having direction-sighting indications according to the present invention and a mold for manufacturing the same, it becomes easy to manufacture golf balls having direction-sighting indications. In particular, for a tee shot, a golfer makes a swing shot after he/she puts a golf ball on a tee perpendicularly to the crossing points, whereby the direction is established so that a target point for the golf ball to fly is identical to any one of the first, the second and the third indicating lines X', Y' and Z' of the golf ball on the tee.

As shown in FIG. 6, where a plurality of direction-sighting indications are formed on the surface of the golf ball at various angles, use of the golf ball 100 in several directions is effective in a golf rule in that the golf ball 100 from the second shot cannot be touched manually. In other words, an indicating line the most approximate to a target direction is selected when a golfer sights the target direction for the golf ball to fly, thereby allowing the golfer to easily measure and sight a direction.

As described above, the present invention provides a golf ball having direction-sighting indications, wherein a plurality of indicating holes (a kind of dimple), clearly distinguishable in shape and dimension from normal dimples on the outer surface of the golf ball, are formed along equators on the surface of the golf ball during a process of forming the normal dimples on the golf ball, with which indicating lines having two to six crossing points are formed, whereby the golfer can sight a target direction for the golf ball to fly, the producing process of the golf balls marked with the indicating lines for sighting a direction is shortened and simplified, the percentage of golf balls having bad quality is decreased, productivity is increased and the production cost is reduced.

In addition, in view of a golfer as a user, since the indicating lines for sighting a direction are formed in three dimensions, the user can more correctly sight the target direction for the golf ball to fly, regardless of the landing position of the golf ball, thereby maximizing the user's convenience while golfing by using the golf balls and increasing the attraction of customers to buy them.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A golf ball having direction-sighting indications, comprising:

a first indicating line having a plurality of indicating holes distinguishable in shape and dimension from dimples formed on an outer surface of the golf ball, the first indicating line establishing a straight line extending along an equator on the surface of the golf ball to form a first direction indicating line, on which a starting point and an ending point are identical; and a second indicating line having a plurality of indicating holes identical in shape and dimension to those of the first indicating line, and establishing a second direction indicating line so that two crossing points with the first indicating line are formed and, at the same time, a first axis is formed through the two crossing points and a center of the golf ball.

2. The golf ball according to claim 1, further comprising a third indicating line having a plurality of indicating holes identical in shape and dimension to the indicating holes of the first and second indicating lines, and establishing a third direction indicating line so that one pair of crossing points is respectively formed with each of the first and the second indicating lines, and a second axis and a third axis are respectively formed through the two pairs of crossing points and the center of the golf ball.

3. The golf ball according to claim 1 or 2, wherein the first, the second and the third indicating lines are formed on the outer surface of the golf ball such that two or more first, second and third indicating lines are formed on the surface of the golf ball at equal angular intervals, with the first, the second and the third axes being respectively set as mutual axes of the two or more first, second and third indicating lines.

* * * * *